US005791579A

United States Patent [19]

Raphael et al.

[11] Patent Number: 5,791,579

[45] Date of Patent: Aug. 11, 1998

[54] OVERLOAD PREVENTION CLUTCH ASSEMBLY

[75] Inventors: Julian J. Raphael; Neil S. Pennington, both of Abingdon, Va.

[73] Assignee: Columbus McKinnon Corporation, Amherst, N.Y.

[21] Appl. No.: 709,230

[22] Filed: Sep. 3, 1996

[51] Int. Cl.[6] ..... B66D 1/14

[52] U.S. Cl. ..... 254/368; 254/352; 254/903; 192/56.1; 464/41; 464/43

[58] Field of Search ..... 254/352, 366, 254/368, 369, 903; 192/56.1; 464/30, 41, 34, 35, 36, 37, 38, 40, 43, 45

[56] References Cited

U.S. PATENT DOCUMENTS

| | | | |
|---|---|---|---|
| 445,247 | 1/1891 | Flohr . | |
| 909,768 | 1/1909 | Donaldson . | |
| 996,384 | 6/1911 | Wiard | 464/41 |
| 1,054,480 | 2/1913 | Zinsli | 464/41 |
| 1,111,990 | 9/1914 | Braun | 464/35 |
| 1,190,482 | 7/1916 | Tibbals . | |
| 1,674,979 | 6/1928 | Miller . | |
| 2,006,476 | 7/1935 | Payson | 254/187 |
| 2,175,383 | 10/1939 | Eason | 192/18 |
| 2,753,703 | 7/1956 | McIntyre | 64/30 |
| 2,881,602 | 4/1959 | Baker et al. | 464/35 |
| 2,894,610 | 7/1959 | Harrington | 192/16 |
| 2,960,852 | 11/1960 | Schroter et al. | 464/35 |
| 3,082,643 | 3/1963 | Grassi et al. | 464/35 X |
| 3,090,601 | 5/1963 | Robins et al. | 254/169 |
| 3,220,702 | 11/1965 | Caldwell | 254/187 |
| 3,399,867 | 9/1968 | Schroeder | 254/168 |
| 3,648,483 | 3/1972 | Garcia, Jr. | 464/43 |
| 3,724,815 | 4/1973 | Hawkins et al. | 254/169 |
| 3,744,760 | 7/1973 | Uher | 254/187 R |
| 3,797,621 | 3/1974 | James | 192/56 |
| 3,953,000 | 4/1976 | Zorbaugh | 254/169 |
| 4,062,203 | 12/1977 | Leonard et al. | 464/38 |
| 4,466,598 | 8/1984 | Eggleton et al. | 254/358 |
| 4,664,357 | 5/1987 | Nishimura | 254/351 |
| 4,721,492 | 1/1988 | Maurer | 464/38 |
| 4,768,754 | 9/1988 | Nishimura | 254/351 |
| 4,928,802 | 5/1990 | Weiss et al. | 464/38 X |
| 5,366,412 | 11/1994 | Beaty et al. | 464/38 |

FOREIGN PATENT DOCUMENTS

| | | | |
|---|---|---|---|
| 1048750 | 1/1959 | Germany | 464/43 |

*Primary Examiner*—Donald P. Walsh
*Assistant Examiner*—Emmanuel M. Marcelo
*Attorney, Agent, or Firm*—Bean, Kauffman & Snyder

[57] ABSTRACT

An overload prevention clutch assembly features input and output members connected by a coupling member, which is resiliently deformable under the control of threaded fasteners to vary the torque which may be transmitted between the input and output members across the coupling member. The fasteners serve to mount the coupling member on the output member, whereupon the coupling and output members cooperate to mount the input member in assembled relationship therewith.

15 Claims, 2 Drawing Sheets

OVERLOAD PREVENTION CLUTCH ASSEMBLY

BACKGROUND OF THE INVENTION

The invention relates to improvements in manually operated hoists and more particularly to the fitting of such hoists with an overload protection device operable to limit the weight of a load which can be lifted.

It is known to provide chain and lever operated hoists with overload protection devices, as evidenced for example by U.S. Pat. Nos. 4,466,598 and 4,768,754. In U.S. Pat. No. 4,466,598, the overload device is associated with the mounting flange of a chain wheel and includes threaded fasteners operable to resiliently deform such mounting flange. In U.S. Pat. No. 4,768,754, the overload device is arranged operably intermediate a manual lever operator and a Weston brake.

SUMMARY OF THE INVENTION

The present invention is directed towards an overload prevention clutch assembly adapted for use in preventing overloading of a hoist, and more particularly to an assembly adapted for installation in a lever operated hoist of the type employing a Weston brake.

The present overload prevention clutch assembly is generally characterized as having an output means, such as a hub, adapted to be operably coupled to a load lifting means of a hoist; an input means, such as a ratchet ring, adapted to be operably coupled to operator means of such hoist; and coupling means for mounting the ratchet ring on the hub in a manner allowing torque transmitted between the input and output means to be adjustably varied. The coupling means preferably includes a resiliently deformable coupling member providing a radially outwardly facing clutch surface arranged for engagement with a radially inwardly facing clutch surface defined by the ratchet ring, and mounting means for both mounting the coupling member on the hub and adjustably effecting resilient deformation of the coupling member to vary the degree of frictional engagement between the clutch surfaces, whereby to adjustably vary the torque to be transmitted across such clutch surfaces.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
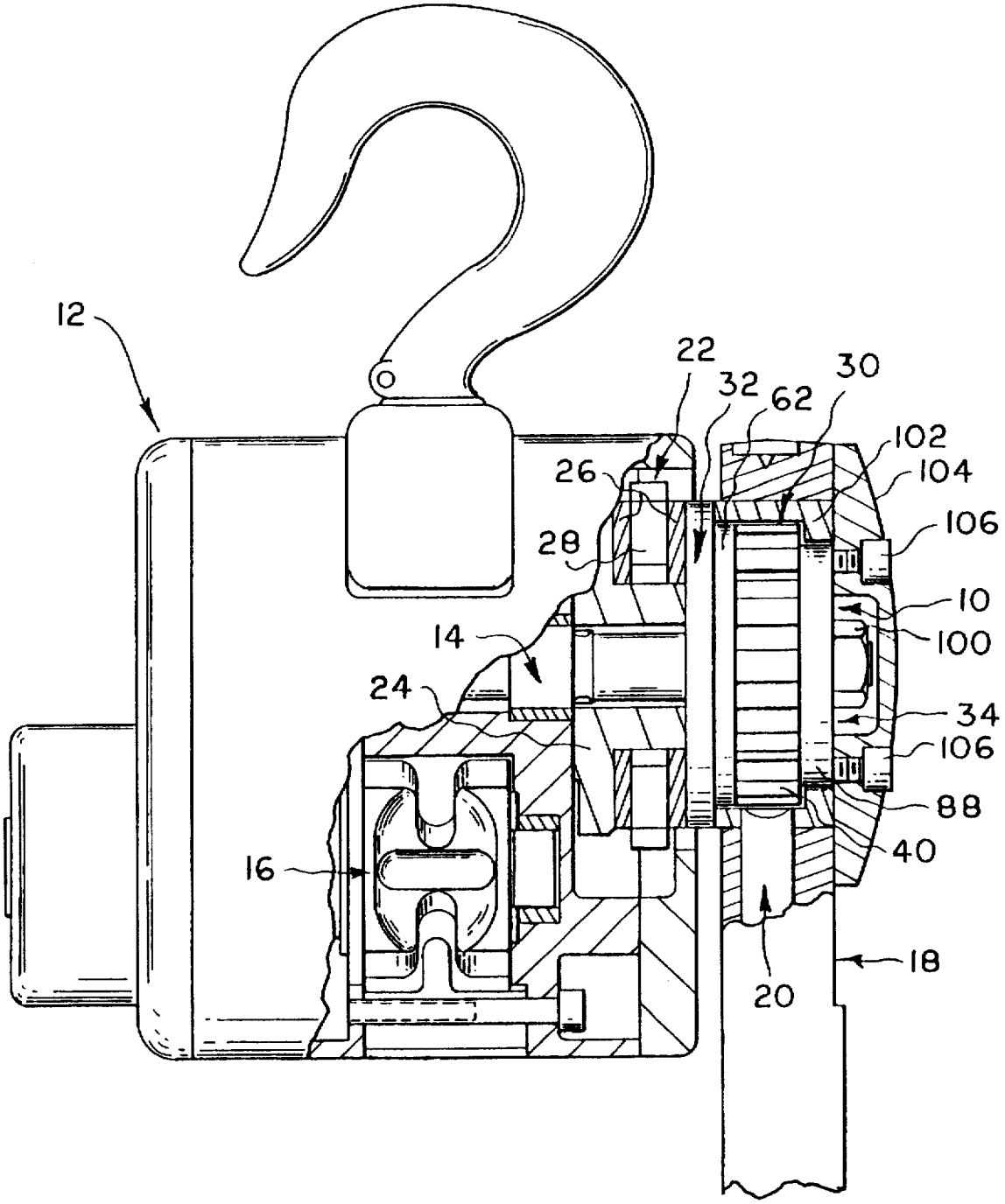
FIG. 1 is a side elevational view in partial section showing an overload prevention clutch assembly of the present invention mounted within a lever operated chain hoist.

An overload prevention clutch assembly formed in accordance with a preformed form of the present invention is generally designated as 10 and shown in FIG. 1 as being supported within a hoist 12, which is conventional from the standpoint that it includes a driven shaft 14 operably coupled to load lifting means, including a chain hoist wheel 16; hoist operator means, such as for example, a lever operator 18 having a reciprocating lever ratchet 20; and a conventional Weston brake 22, including a friction hub 24 spline connected to shaft 14, a pair of friction discs 26,26 and a ratchet 28 engageable with a ratchet paw, not shown, to limit rotation of the ratchet to a load lift direction. Thus, it will be understood that clutch assembly 10 takes the place of a ratchet device, not shown, typically fitted in hoists of the type illustrated.

Figure 2:
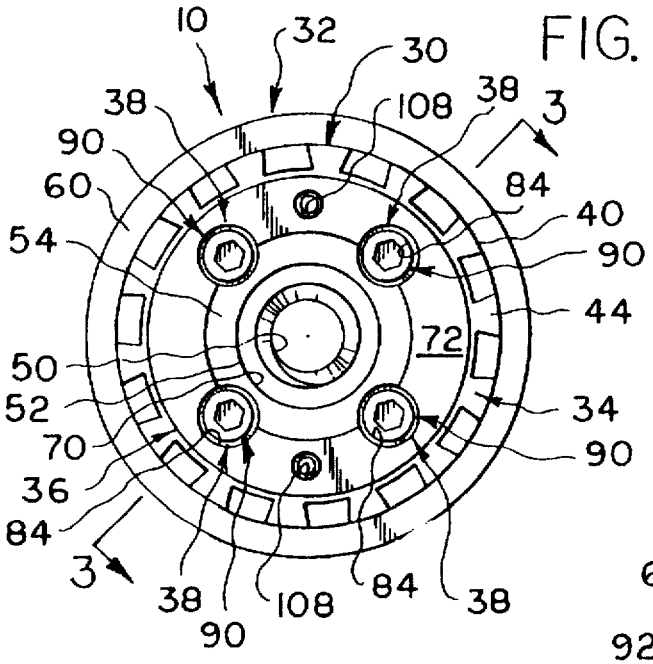
FIG. 2 is an end view of the assembly, as viewed from the right of FIG. 1.
Figure 3:
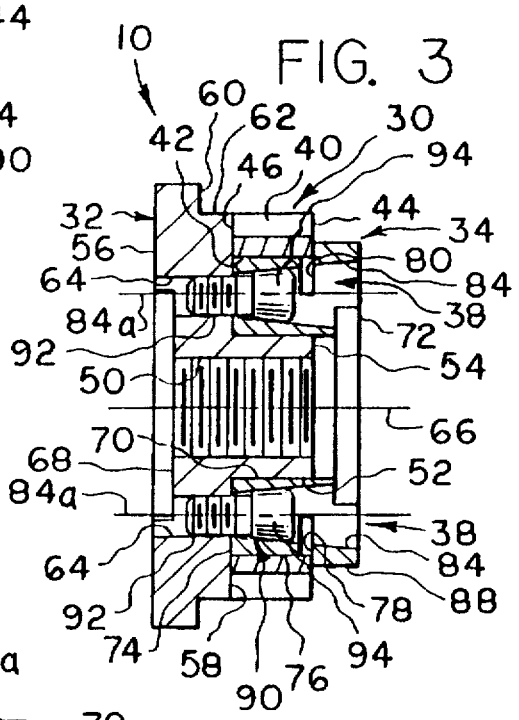
FIG. 3 is a sectional view taken generally along the line 3—3 in FIG. 2.
Figure 4:
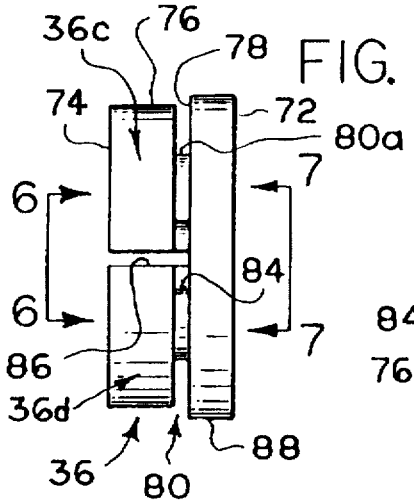
FIG. 4 is a side elevational view of the ratchet ring insert incorporated in the present clutch assembly.

Now referring to FIGS. 2 and 3, it will be seen that clutch assembly 10 generally includes an input means in the form of a ratchet ring 30; an output means in the form of a mounting hub 32; and coupling means 34 including a ratchet ring insert or coupling member 36 and mounting means 38.

Ratchet ring 30 is formed with radially outwardly facing and annularly arranged ratchet teeth 40 by which the ratchet ring is operatively connected to lever 18 via lever ratchet 20; a first radially inwardly facing annular clutch surface 42; and a pair of first axially opposite facing or radially extending annular end surfaces 44 and 46.

Hub 32 is formed with an axially through, screw threaded mounting opening 50 for mounting the hub on shaft 14; a first axially extending mounting surface preferably defined by a radially outwardly facing cylindrical surface 52 disposed concentrically of threaded opening 50; a second pair of axially oppositely facing and radially extending annular end surfaces 54 and 56; a first radially extending annular motion limiting surface 58; a radially extending annular bearing surface 60; a first cylindrical bearing surface 62 disposed concentrically of threaded opening 50; four screw threaded openings only two of which are shown in FIG. 3 as 64 and as extending parallel to and preferably equidistant from the axis 66 of threaded opening 50; and an axially recessed clearance surface 68. Hub 32, when mounted on shaft 14, is operably connected to load lifting means of the hoist via Weston brake 22 and drive shaft 14.

Figure 7:
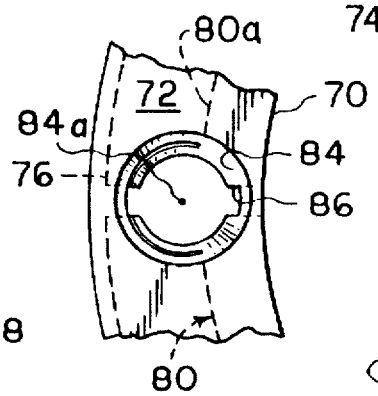
FIG. 7 is an enlarged fragmentary view taken generally along the line 7—7 in FIG. 4.
Figure 6:
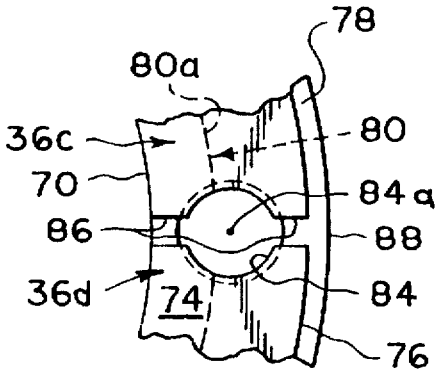
FIG. 6 is an enlarged fragmentary view taken generally along the line 6—6 in FIG. 4.
Figure 5:
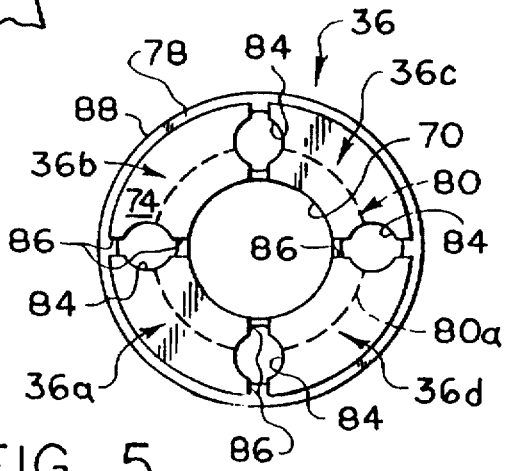
FIG. 5 is an end elevational view of the ratchet ring insert, as viewed from the left of FIG. 4.

Ratchet ring insert 36 is formed with an axially through generally cylindrical opening 70 extending between a third pair of axially oppositely facing and radially extending annular end surfaces 72 and 74; a second radially outwardly facing annular clutch surface 76; a second radially extending annular motion limiting surface 78; an annularly extending relief slot 80 arranged to extend radially inwardly of second clutch surface 76 adjacent second motion limiting surface 78; a plurality of frustroconical mounting openings 84 arranged for axial alignment with threaded openings 64 and to converge from adjacent third end surface 72 towards third end surface 74; a plurality of relief slots 86 arranged to extend radially between second clutch surface 76 and opening 70 and axially between second motion limiting surface 78 and third end surface 74 in an axially bisecting relationship with each of mounting openings 84; and a second cylindrical bearing surface 88. Preferably, the axes 84*a* of mounting openings 84 are parallel and equidistant from cylindrical opening 70; and the radial distance between opening 70 and the inner annularly extending surface 80*a* of relief slot 80 is preferably less than the radial distance between axes 84*a* and surface 70, as best shown in FIGS. 6 and 7. Relief slots 86 cooperate to divide that portion of ratchet ring insert 36 arranged radially inwardly of second clutch surface 76 into four annular segments 36*a*, 36*b*, 36*c* and 36*d*, which are subject to resilient deformation in the manner to be described. As best shown in FIG. 3, clutch surfaces 42 and 76 may be of cylindrical configuration.

Mounting means 38 includes previously referred to threaded openings 64 and frustroconical mountings 84, and a plurality of threaded fasteners 90 each having a threaded shank portion 92 threadably received one within each of threaded openings 64 and a frustroconical head portion 94 sized for receipt one within each aligned one of mounting openings 84. The axial length of head portions 94 is less than the axial length of that portion of mounting openings 84, which extends between annularly extending relief slot 80 and third end surface 74.

By referring to FIG. 3, it will be understood that the elements comprising the overload prevention clutch of the present invention are assembled by first mounting ratchet ring 30 on ratchet ring insert 36 to position first clutch surface 42 in radial alignment and in rotatable engagement with second clutch surface 76 and then mounting the ratchet ring insert on hub 32 to position the wall of opening 70 in radial alignment and sliding engagement with mounting surface 52 and to position third end surface 74 in abutting engagement with first motion limiting surface 58 with mounting openings 84 arranged in alignment with threaded openings 64. Assembly is completed by inserting threaded fasteners 90 into mounting openings 84 and threading their shank portions 92 into threaded openings 64 until head portions 94 engage within mounting openings 84 and clamp third end surface 74 in surface-to surface engagement with first motion limiting surface 58, as shown in FIG. 3. When the clutch is so assembled, facing first and second motion limiting surfaces 58 and 78 loosely engage with ratchet ring 30 and cooperate to maintain first clutch surface 42 in radial alignment with second clutch surface 76, while being spaced axially apart sufficiently to permit relatively free movement of first end surfaces 44 and 46 relative to surface 78 and 58, respectively.

Subsequent to assembly of clutch assembly 10, threaded fasteners 90 are tightened as required to deform ratchet ring insert segments **36*a*–36*d* and force second clutch surface 76 to move radially outwardly into tight fitting frictional engagement with first clutch surface 42, such that ratchet ring 30 and ratchet ring insert 36, and thus hub 32, are coupled or frictionally locked together for conjunctive rotational movement for some predetermined hoist loading condition. When such predetermined hoist loading condition is subsequently exceeded, as when a hoist operator attempts to lift a load exceeding that for which the hoist is designed, the frictional force initially serving to maintain clutch surfaces 42 and 76 coupled for conjunctive movement is exceeded or overcome with the result that the clutch surfaces 42 and 76 are permitted to rotatably slide or slip relative to one another, thereby to drivingly uncouple ratchet ring 30 relative to ratchet ring insert 36, and thus hub 32**.

The assembled clutch assembly 10 is subsequently mounted on drive shaft 14 by threading hub 32 thereon to arranged hub end surface 56 for frictional axial bearing engagement with an adjacent one of friction discs 26 of Weston brake 22 with hub recessed surface 68 providing for free movement of the hub relative to friction hub 24 of the Weston brake. Assembly 10 is releasably retained on shaft 14 by a retaining nut 100 arranged to engage with hub end surface 54. Thereafter, a lever insert 102 is slid onto hub bearing surface 62 and ratchet ring insert bearing surface 88, and a lever cover 104 is fixed to ratchet ring insert 36 by a pair of threaded fasteners 106 received within threaded openings 108 opening through ratchet ring insert end surface 72.

If during use of hoist 12 there should occur a wearing away of clutch surface 42 and/or 76, or it is desired to change the value of the torque loading at which slippage between such clutch surfaces is to occur, lever cover 104 may be temporarily removed to afford access to screw head portions 94 for adjustment purposes.

In order to minimize temperature effects on the frictional force exerted between clutch surfaces 42 and 76, and thus the torque at which slippage between such surfaces will occur, it is necessary that coefficients of thermal expansion of ratchet ring 30 and ratchet ring insert 36 be essentially identical over the expected operating temperature range of hoist 12. To this end, copper alloy C54400 (Phosphor Bronze, Free Cutting) and AISI type 304 Stainless Steel were selected for forming ratchet ring insert 36 and ratchet ring 30, respectively. Both of these materials possess a coefficient of thermal expansion of $9.6\times10^{-6}$ in/in/°F. Stainless steel is chosen for forming the ratchet ring due to the relatively high input loading to which it is exposed during use.

While the present invention is disclosed for use with a lever operated hoist, it is contemplated that it would possess utility with a chain block type hoist.

What is claimed is:

1. An overload prevention clutch assembly for a hoist having hoist operator means for operating said hoist and load lifting means for lifting a load, said assembly comprising:

an input and an output adapted to be operably coupled to said operator means and said load lifting means, respectively, and means for mounting said input on said output and for transferring torque from said input to said output and including a resiliently deformable member and means for mounting said member on said output in torque transmitting frictional engagement with said input and for adjustably resiliently deforming said member for varying the torque that can be transmitted by said member from said input to said output, and said member is rotationally fixed relative to said output and supports said input for rotation relative to said output.

2. An overload prevention clutch assembly for a hoist having hoist operator means for operating said hoist and load lifting means for lifting a load, said assembly comprising:

an input adapted to be operably coupled to said operator means and having a radially inwardly facing first clutch surface;

an output adapted to be operably coupled to said load lifting means;

a coupling member having a radially outwardly facing second clutch surface arranged for rotatable, frictional surface-to-surface sliding engagement with said first clutch surface and being resiliently deformable to permit radial movement of said second clutch surface to vary the degree of frictional engagement of said first and second clutch surfaces, thereby to adjustably vary the torque to be transmitted thereacross; and mounting means for mounting said coupling member on said output and for adjustably resiliently deforming said coupling member, thereby to move said second clutch surface radially relative to said first clutch surface, said coupling member is fixed against rotation relative to said output, and said coupling member and said output are arranged for engagement with said input to maintain said first clutch surface radially aligned with said second clutch surface.

3. An assembly according to claim 2, wherein said mounting means includes threaded openings formed in said output, frustroconical mounting openings formed in said coupling member, and threaded fasteners, said threaded fasteners each having a threaded shank portion threadably received in one of said threaded openings and a frustroconical head portion received in one of said mounting openings and being adjustably axially thereof to effect radial movement of said second clutch surface.

4. An overload prevention clutch assembly for a hoist having hoist operator means for operating said hoist and load lifting means for lifting a load, said assembly comprising:

an input adapted to be operably coupled to said hoist operator means, said input defining a first radially facing clutch surface;

an output adapted to be operably coupled to said load lifting means and;

coupling means for mounting said input on said output and for adjustably varying the torque that can be transmitted between said input and output, said coupling means including a resiliently deformable member defining a second radially facing clutch surface arranged for frictional surface engagement with said first clutch surface, and mounting means for mounting said member on said output for rotation therewith and for adjustably resiliently deforming said member to vary the torque transmitted between said input and output across said clutch surfaces, said clutch surfaces supporting said input on said member for relative rotational movement therebetween, and frictional surface engagement of said clutch surfaces tending to prevent relative rotation thereof.

5. An overload prevention clutch assembly according to claim 4, wherein said mounting means includes threaded openings defined by said output, frustroconical mounting openings defined by said member and threaded fasteners, and each of said threaded fasteners has a threaded shank portion threadably received by one of said threaded openings and a frustroconical head portion received within one of said mounting openings and adjustably axially thereof to radially deform said member.

6. An overload prevention clutch assembly according to claim 5, wherein said input and said member have essentially the same coefficient of thermal expansion.

7. An overload prevention clutch assembly comprising in combination:

an output having a first axially extending mounting surface, a first axially facing movement limiting surface and a plurality of axially extending threaded openings;

an input having a first radially inwardly facing clutch surface and first axially oppositely facing end surfaces;

a ring having a second axially extending mounting surface removably supported on said first mounting surface, a second radially outwardly facing clutch surface arranged for frictional surface engagement with said first clutch surface, second axially oppositely facing end surfaces, a second axially facing movement limiting surface spaced from said first movement limiting surface and cooperating therewith to limited axial displacements of said first end surfaces, and a plurality of axially extending frustroconical openings extending between said second end surfaces for alignment with said threaded openings, said ring being resiliently deformable in a radially extending direction; and a plurality of mounting members having threaded shank portions threadably receivable within said threaded openings and frustroconical head portions receivable within said frustroconical openings and engageable therewith to resiliently radially deform said ring for adjustably moving said second clutch surface radially of said first clutch surface to vary the torque which can be transmitted across said clutch surfaces between said input and output.

8. An overload prevention clutch assembly according to claim 7, wherein said first and second mounting surfaces are of cylindrical configuration, and said first and second movement limiting surfaces are of radially extending annular configuration.

9. An overload prevention clutch assembly according to claim 7, wherein said input and said ring have essentially the same coefficient of thermal expansion.

10. A hoist having in combination:

a lever operator fitted with a lever ratchet; a load lifting means for lifting a load; a shaft coupled to said load lifting means; a Weston brake having a hub connected for rotation with said shaft and mounting a pair of friction discs arranged to straddle a ratchet, said hub frictionally engaging one of said friction discs; and an overload prevention clutch assembly comprising a mounting hub threadably supported by said shaft and arranged to axially engage another of said friction discs of said Weston brake, a ratchet ring having radially outwardly extending teeth arranged for engagement by said lever ratchet and a radially inwardly facing first clutch surface, a resiliently deformable ratchet ring insert having a radially outwardly facing second clutch surface and mounting means for clamping said ratchet ring insert to said mounting hub for rotation therewith, said mounting hub and said ratchet ring insert cooperating to maintain said clutch surfaces in radial alignment, said ratchet ring insert being adjustably resiliently deformable by said mounting means for adjustably moving said second clutch surface radially relative to said first clutch surface to vary the torque which can be transmitted across said clutch surfaces, said clutch surfaces supporting said ratchet ring on said ratchet ring insert for relative rotational movement therebetween, and frictional surface engagement of said clutch surfaces tending to prevent relative rotation thereof, and said clutch surfaces are of cylindrical configuration.

11. A hoist according to claim 10, wherein said mounting means includes a plurality of parallel threaded openings formed in said mounting hub, a plurality of parallel frustroconical mounting openings formed in said ratchet ring insert and arranged for axial alignment with said threaded openings, and a plurality of fasteners having threaded shank portions received within said threaded openings and frustroconical head portions received within said mounting openings and movable axially thereof for resiliently deforming said ratchet ring insert to adjustably move said second clutch surface radially relative to said first clutch surface.

12. A hoist according to claim 11, wherein said ratchet ring and said ratchet ring insert have essentially the same coefficient of thermal expansion.

13. An overload prevention clutch assembly comprising in combination:

an output;

an input having a first clutch surface; and means for mounting said input on said output and having a second clutch surface arranged for rotational surface to surface frictional engagement with said first clutch surface for transferring torque between said input and output, said means including a resiliently deformable member defining said second clutch surface and member mounting means for fixedly mounting said member on and for rotation with said output and for adjustably resiliently deforming said member to effect radial movement of said second clutch surface relative to said first clutch surface for adjustably varying frictional force tending to maintain said second clutch surface in frictional engagement with said first clutch surface and for rotation therewith, and said clutch surfaces are of cylindrical configuration.

14. An assembly according to claim 13, wherein said member is of one piece integral construction.

15. An assembly according to claim 14, wherein said member includes a radially extending annular motion limiting surface arranged to cooperate with said output for maintaining said first clutch surface in radial alignment with said second clutch surface.

* * * * *